US007192216B2

(12) United States Patent
Casale

(10) Patent No.: US 7,192,216 B2
(45) Date of Patent: Mar. 20, 2007

(54) HEIGHT ADJUSTABLE SCREED AND METHOD

(76) Inventor: Michael Casale, 1967 Monroe Ave., North Bellmore, NY (US) 11710

( * ) Notice: Subject to any disclaimer, the term of this patent is extended or adjusted under 35 U.S.C. 154(b) by 227 days.

(21) Appl. No.: 11/066,422

(22) Filed: Feb. 25, 2005

(65) Prior Publication Data

US 2006/0192073 A1 Aug. 31, 2006

(51) Int. Cl.
*E01C 19/22* (2006.01)
*E01C 19/12* (2006.01)

(52) U.S. Cl. ..... 404/118; 404/101

(58) Field of Classification Search ..... 404/118, 404/92, 101
See application file for complete search history.

(56) References Cited

U.S. PATENT DOCUMENTS

| | | | | |
|---|---|---|---|---|
| 1,745,058 | A * | 1/1930 | Rossi | 52/713 |
| 1,838,635 | A | 12/1931 | Pilj | |
| 1,939,007 | A | 12/1933 | Heltzel | |
| 2,129,568 | A | 9/1938 | DeBiasi | |
| 2,319,526 | A | 5/1943 | Wearn | |
| 2,331,949 | A | 10/1943 | Whiteman | |
| 2,373,284 | A | 4/1945 | Autrey | |
| 2,551,826 | A | 5/1951 | Cox, Sr. | |
| 2,873,529 | A | 2/1959 | Hogan et al. | |
| 4,115,976 | A | 9/1978 | Roher | |
| 4,158,937 | A | 6/1979 | Henry | |
| 4,861,188 | A | 8/1989 | Rouillard | |
| 4,909,002 | A | 3/1990 | Clifton et al. | |
| 4,945,698 | A | 8/1990 | Jertberg et al. | |
| 5,154,536 | A | 10/1992 | Ciudaj | |
| 5,257,764 | A | 11/1993 | Spaulding | |
| 5,324,085 | A | 6/1994 | Hintz, Jr. | |
| 5,460,461 | A | 10/1995 | McGrath | |
| 5,609,437 | A * | 3/1997 | Silva | 404/118 |
| 5,676,489 | A * | 10/1997 | Willhoite | 404/93 |
| 6,223,495 | B1 * | 5/2001 | Shaw et al. | 62/749.1 |
| 6,397,542 | B1 | 6/2002 | Flores | |
| D483,632 | S | 12/2003 | Masseria | |
| 6,719,486 | B2 | 4/2004 | Craghan | |
| 6,779,945 | B2 | 8/2004 | Saffo, Sr. | |
| 2002/0129507 | A1 * | 9/2002 | Vecchio | 33/625 |

OTHER PUBLICATIONS

Pave Tech Corporation, "Curb Kit for SandPull Pro", 2005, 1 page website.

* cited by examiner

*Primary Examiner*—Raymond Addie
(74) *Attorney, Agent, or Firm*—Alfred M. Walker

(57) ABSTRACT

A height adjustable paving stone screed for use in an area bounded by a course of paving stones includes an elongated board. A pair of right angle brackets are mounted on top of the board. Slidably attachable to each right angle brackets include a pair of further right angle brackets, each adjustable vertically with respect to the first right angle bracket. The bottom of each angled bracket is flush with the top the paving stones. Likewise, the bottom surface of the board is even with bottom surfaces of the paving stones, whereby sliding movement of the board establishes a flat plane of bedding material bed at a depth equal to that of the course of paving stones, in the area to support paving stones to fill the area. Sliding movement of the board occurs, establishing a flat plane of to flatten the bedding material for the paving stones.

10 Claims, 5 Drawing Sheets

HEIGHT ADJUSTABLE SCREED AND METHOD

FIELD OF THE INVENTION

The present invention relates to screeds for leveling sand or other base mix for bricks and other paving stones.

BACKGROUND OF THE INVENTION

Typically a screed is a plank or board that is raked over rails or flat supports at both edges to flatten wet concrete to a planar surface at the same height as the top edge of the support rails. However, in a second application of this invention, a screed is used by bricklayers or construction crews in preparing a flat surface of dry bedding mix such as sand or sand/concrete prior to laying brick or paving blocks for walkways, patios or the like. A carefully laid edge of bricks or paving blocks, known as a soldier's course, is first laid around the perimeter of the area to be covered and allowed to set. The top surface of this soldier's course defines a plane. The filler blocks or bricks must be laid so that their top surfaces are properly co-planar with the soldier's course. This necessitates excavating the enclosed ground area below the edge brick height and then introducing a layer of bedding mix so that the blocks or bricks laid in the central area have their bottom surface exactly a brick or block height below the top surface of the bricks or blocks of the soldier's course. A board or plank with bottom corners cut out at the height of a brick/block is commonly used as a screed to flatten the inside surface; it is sized so that the bottom length is slightly less than the width of the inside of the soldier's course. Then, this screed is passed over the tops of the soldier's course bricks/blocks. This involves careful cutting of the board, especially the height dimension of the bottom corner cut-outs.

The prior art relates to screeds and screed supports or rails. U.S. Pat. No. 2,373,284 of Autrey describes an adjustable screed using multiple adjustable legs and wire tie downs to maintain a proper grade elevation while rodding or leveling fresh concrete. It is not useful for laying brick/block for paving. U.S. Pat. No. 5,154,536 of Ciudaj describes an adjustable screed rail that is height adjustable and lockable via bolts and wing nuts in slotted holes in web sections of two mating parts of the rail. U.S. Pat. No. 4,945,698 of Jertberg et al. describes an adjustable screed support for use on walls; this also is a two-part rail type system with adjustment from bolts and nuts in slotted holes. Since the paving application relies on the top surface of the soldier's course for plane determination, there is not a use for adjustable rails or supports such as Ciudaj '536 or Jertberg '698. Another distinction is that the latter two patents describe elements for one-time use which are embedded in the concrete structure. Other prior art, such as U.S. Pat. Nos. 5,460,461 of McGrath, U.S. Pat. No. 5,324,085 of Hintz, and Des. 483,632 of Masseria, relates to handles attached to screed boards. These are not height adjustable screeds.

A commercial height adjustable screed of Pave Tech Corporation includes a rail oriented system using rollers on the bricks of the course as a rail. The screed is a metal scoop. The Pave Tech device is not a set of L-shaped brackets retrofitted to a common board. Instead, it uses a specialized screed shovel scoop requiring an upward bar, and a complicated roller mechanism as part of the adjustment feature.

OBJECTS OF THE INVENTION

It is therefore an object of the present invention to provide height adjustable screeds for leveling sand or other base mix for bricks and other paving stones.

It is also an object to improve over the disadvantages of the prior art.

SUMMARY OF THE INVENTION

In keeping with these objects and others which may become apparent, this invention is a height (depth) adjustable screed that can be easily adjusted on-site to match the height of a variety of brick or paving block used in paving.

Besides the brackets and fasteners, all that is needed to complete the adjustable screed of this invention is a board or plank such as a 2×4 or 2×6 board, which is straight cut slightly narrower than the paving course to be laid within the width of the soldier's course. Two identical right angle brackets are used at the top distal ends of the screed board. They are screwed to the top edge with the flat upright (with slotted hole) aligned with the end of the screed board. A second right angle bracket is attached to the board mounted bracket (at each end) using two carriage bolts with flat serrated washers and wing nuts through the mating slotted hole surface.

The screed board is held vertically with its bottom edge in contact with a flat surface; a brick or paving block is placed adjacent to the end of the screed board. Then the bottom of the flat base of the overhanging bracket is brought down to contact the top surface of a brick or paving block. The wing nuts are tightened. This results in a screed board that can be forced down so that the overhanging brackets on either end contact the top surface of the soldier's course. At this position, the bottom of the screed board matches the depth of the brick or block of the soldier's course; it can then be used to spread out the bedding mix at the proper depth to define a proper bedding plane.

In a second embodiment, the bracket that attaches to the screed board is provided with a channel slightly larger than the thickness of the screed board which acts as an integral clamp. Instead of screwing the bracket to the board, the top edge of the board is placed in the channel and two hand-tight screws on one side apron of the channel are screwed against the board surface thereby capturing the board between the screw ends and the distal channel apron. This makes it easier to transfer brackets to other screed boards (no tools necessary) as may be necessary when using different widths or replacing worn screeds.

Screed boards may be made of common lumber, plywood, fiberglass, wood/resin composites, or pressure treated wood. The channel bracket may be made of die cast aluminum alloy or zinc or may be bent from flat stock in steel or aluminum alloy.

In a third embodiment of this invention, the height adjustable screed is also width adjustable. Besides being adaptable to a variety of widths for use in paving rectangular areas or walkways, it can be used for leveling other shapes or irregular areas. Using three shorter screed planks, the width is adjusted via studs in a central plank riding in slots in the two outer planks. A total adjustment of approximately 2.5:1 is achievable. Wing nuts are used to lock in the adjusted width. A top bearing strip on the center plank is used to align the top edges of all three planks thereby insuring the coplanar alignment of the bottom smoothing surfaces. A version with only one outer plank and the center plank can also be used; the range of adjustment will be less however.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
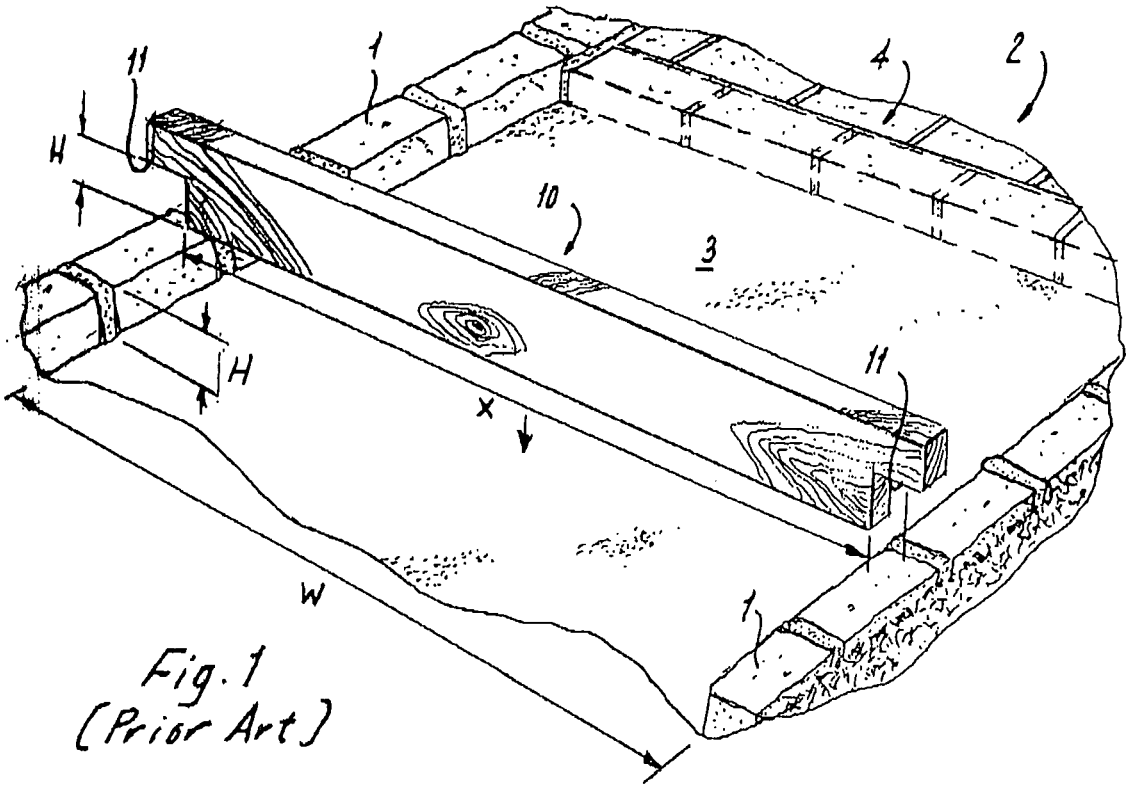
Fig. 1 (Prior Art)
FIG. 1 is a perspective view of a prior art screed board tool, shown being used on a laid course of paving blocks or bricks, illustrating the height dimension, "H" of the paving blocks or bricks.

FIG. 1 shows a prior art indented screed board 10, having cutouts 11 with a height "H" comparable to height "H" of a soldier's course 2 of bricks or paving blocks 1, each also having height "H".

FIG. 1 also shows a soldier's course 2 laid of blocks 1 with internal width W. Area 3 is excavated below the height "H" and a bedding mixture is introduced, which must be carefully flattened into a plane at depth "H" before additional filler blocks 4 are introduced.

Typically, a prior art screed board 10 (as in FIG. 1) includes a board with lower corner cutouts. Edges 11 are placed over the top surface of blocks 1 at the sides of soldier's course 2 and skimmed over the area to flatten the bedding mix in region 3 of FIG. 1. Portion "X" of screed board 10 is sized slightly shorter than width "W", and the height (or depth) measurement is carefully cut to match height "H", the height of paving block 1.

Figure 2:
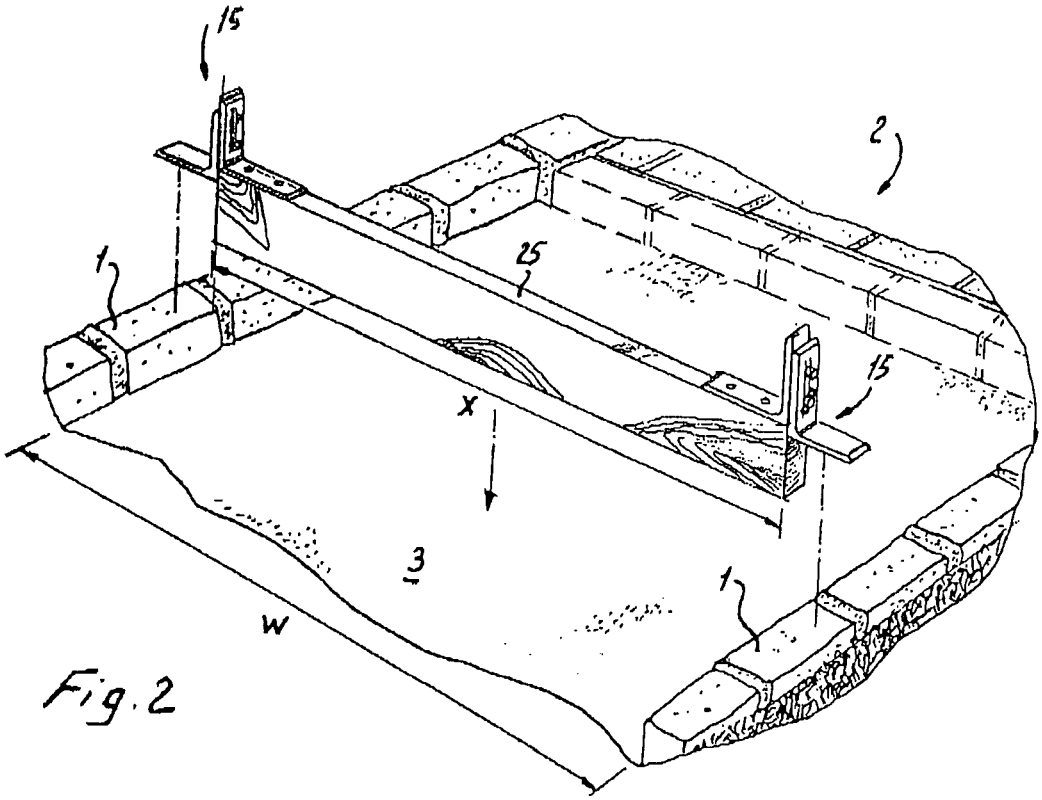
FIG. 2 is an exploded perspective view of one embodiment of the height adjustable screed tool of the present invention, shown being used upon a laid soldier's course of paving blocks or bricks, with an inner width "W" and showing in dashed lines filler bricks, to be added upon a paving site.
Figure 3:
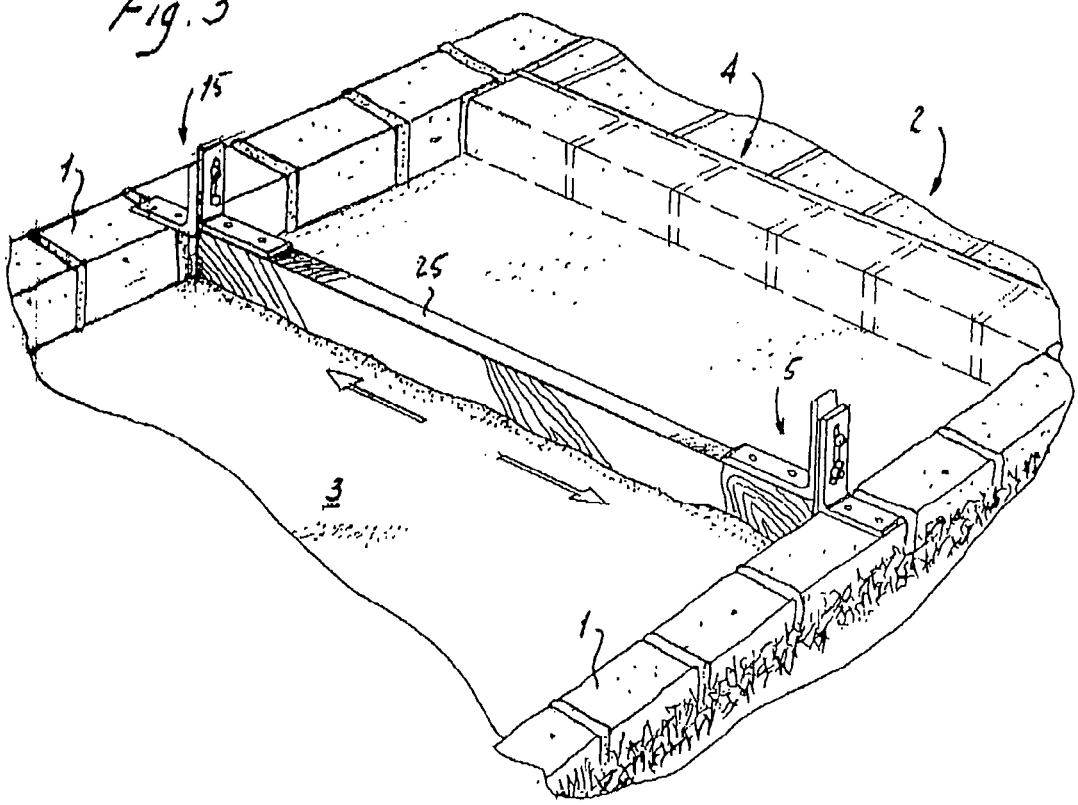
FIG. 3 is a perspective view of the height adjustable screed tool of FIG. 2, shown also being used on the paving site depicted therein.

FIGS. 2 and 3 show the height or depth adjustable screed board 25 of a first embodiment of this invention, which uses the components of bracket kit 15 (see FIG. 4) at each end.

Figure 4:
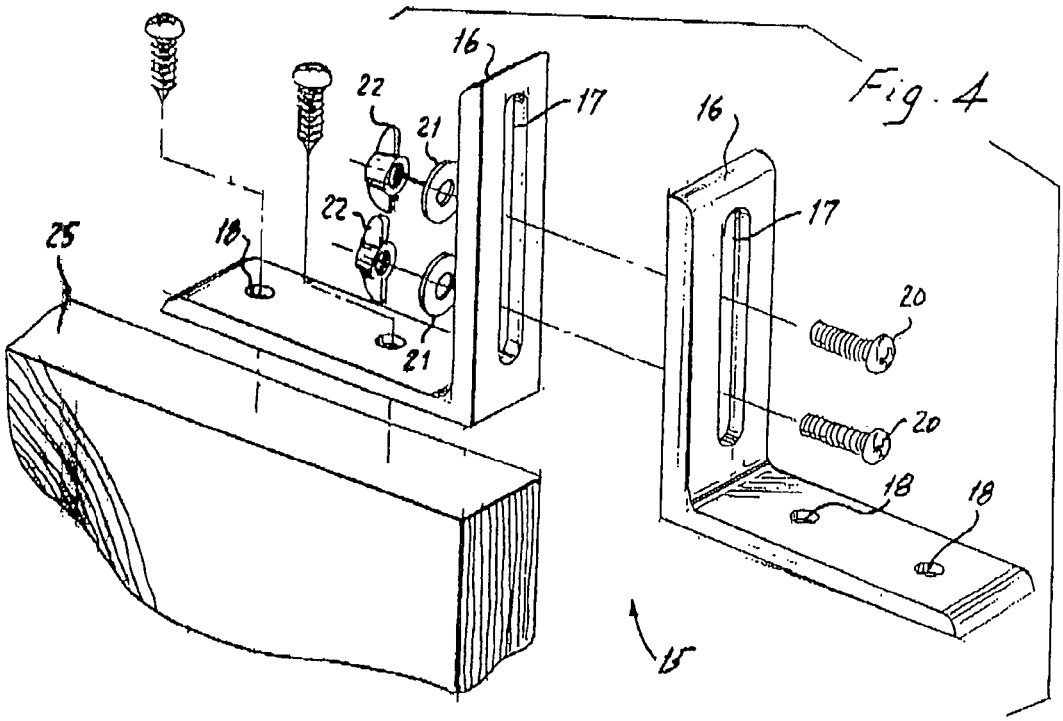
FIG. 4 is a perspective view of the brackets and fasteners used with at he screed tool of FIGS. 2 and 3, shown as a kit, to be used at each top end of a screed board of the embodiment of the present invention shown in FIGS. 2 and 3.

As also shown in FIG. 4, this kit includes two identical right angle brackets 16 with slot 17 in one flange, two fasteners, such as carriage bolts 20, which fit slot 17, two optional serrated washers 21, and two tighteners, such as wing nuts 22.

Figure 5:
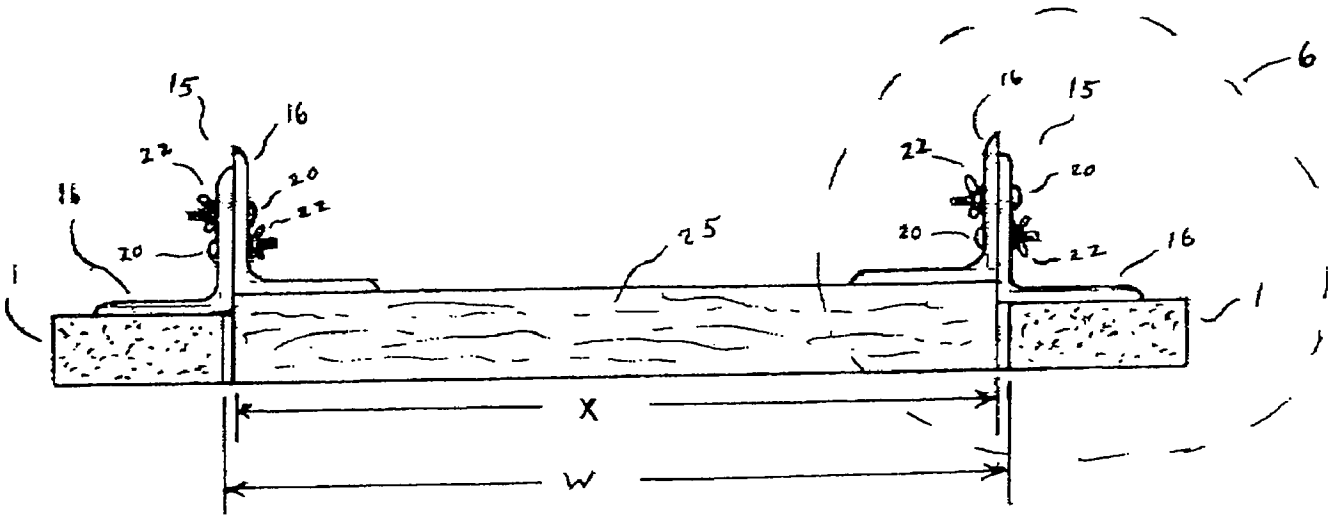
FIG. 5 is a side elevational view of the height adjustable screed of the embodiment shown in FIGS. 2–4, showing its fit within the width of two paving blocks of a soldier's course.
Figure 6:
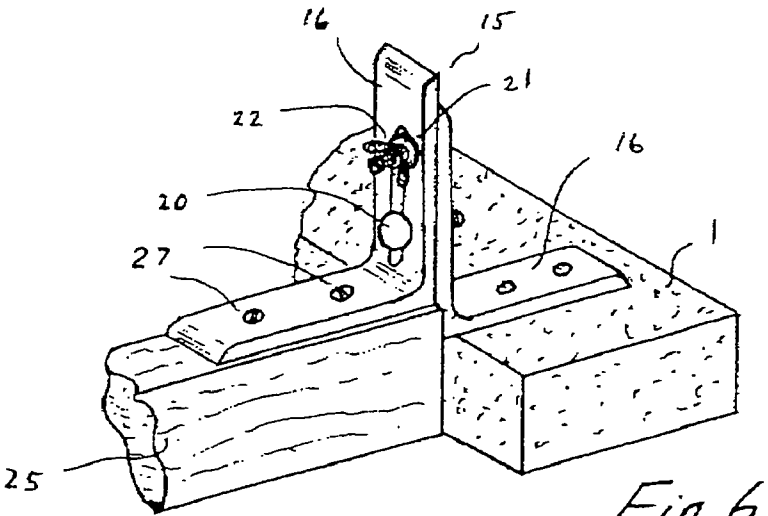
FIG. 6 is a close-up perspective view in partial section of a detail of the right side of the screed board of FIG. 5, showing the installation of the bracket kit.

FIGS. 5 and 6 show screed board 25 cut to size with kit components 15 installed at each end. Prior to installation between soldier's course blocks 1 of FIG. 5, an adjustment is made as shown in FIG. 6. Screed board 25 is placed on a flat surface with bracket 16 screwed in registration with the end via screws 27. The second bracket 16 is attached to the first through mating slots with carriage bolts 20 introduced from opposite sides. This is to provide clearance for easy manipulation of wing nuts 22. Carriage bolts 20 engage slots 17 with the square boss under the head which then resists rotation. A paving block 1 is placed at the end of board 25 and bracket 16 with overhanging flange is slid down into contact with the top surface and then locked at this position by tightening both wing nuts. The same is done at the other end of board 25. Then the adjusted screed is skimmed over the top block edges of soldiers course 2 to create a flat plane surface of bedding material at a depth of "H" equal to the height of a block 1.

Figure 7:
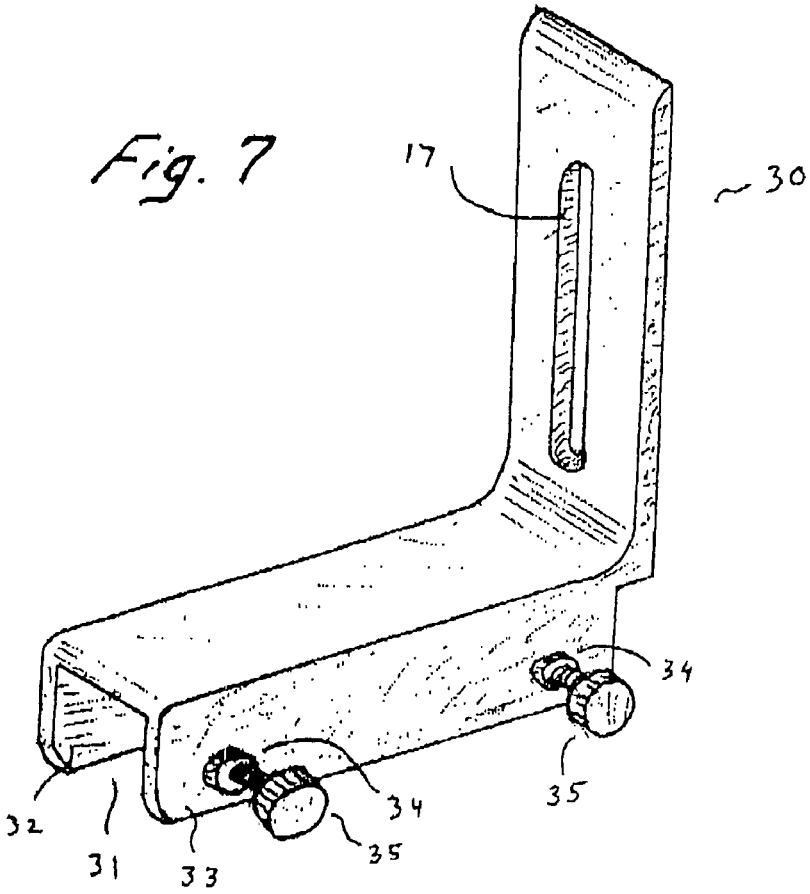
FIG. 7 is a perspective view of a second embodiment of a screed board attachable bracket with a hand tightening integral clamp.

A second embodiment of the screed board attached bracket is shown in FIG. 7. Bracket 30 straddles screed board 25. Additionally, bracket 30, with slot 17 on one flange, has a second flange fitted with an integral channel 31 slightly wider than the thickness of a typical screed board 25 (commonly made of 2×4 or 2×6 lumber). Front flange 33 is fitted with clamping screws 35 with large hand knobs. Optional threaded bosses 34, which can be inserts such as PEM nuts, reinforce the mating female flange threads. For installation, bracket 30 is placed so that the outside of the slotted flange is flush with the end of board 25, then screws 35 are tightened against the side of board 25 thereby clamping it against distal channel flange 32. Not requiring tools, bracket 30 can be easily moved from screed board 25 to another screed board.

FIG. 7 illustrates bracket 30 as it would be made by die casting. An equivalent fabrication method is as a bent-up structure from die cut flat stock. Powdered metal, or even molded plastic resin also can be used for making bracket 30.

Although it is easy to cut a screed board 25 to a fixed width on site for simple rectangular patios or walkways, it would be desirable to have a width adjustable screed board for installations with edge obstacles or for other shapes.

Figure 8:
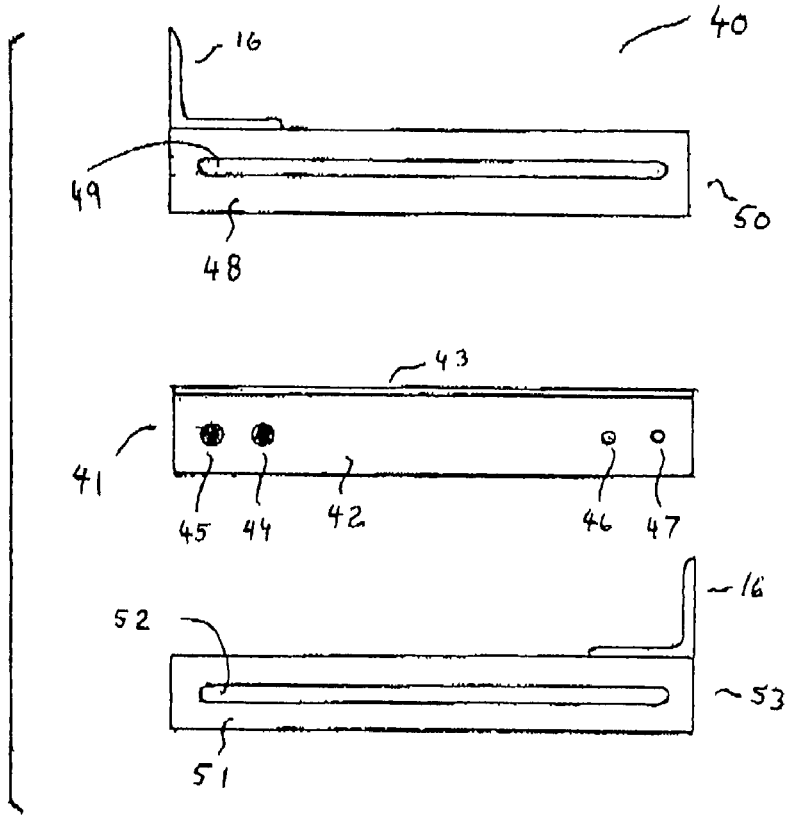
FIG. 8 is a side elevation view of a third embodiment of this invention, showing the three separate planks of a height adjustable and width adjustable screed.
Figure 9:
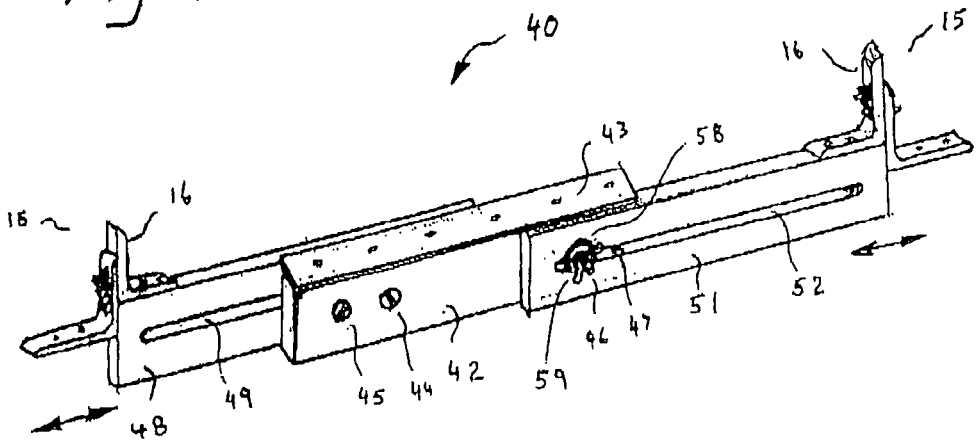
FIG. 9 is a perspective view of the assembled height and width adjustable screed of FIG. 8; and, FIG. 10 is a top view of a portion of an oval soldier's course with the adjustable screed of FIG. 9, shown used at two different width adjustments.
Figure 10:
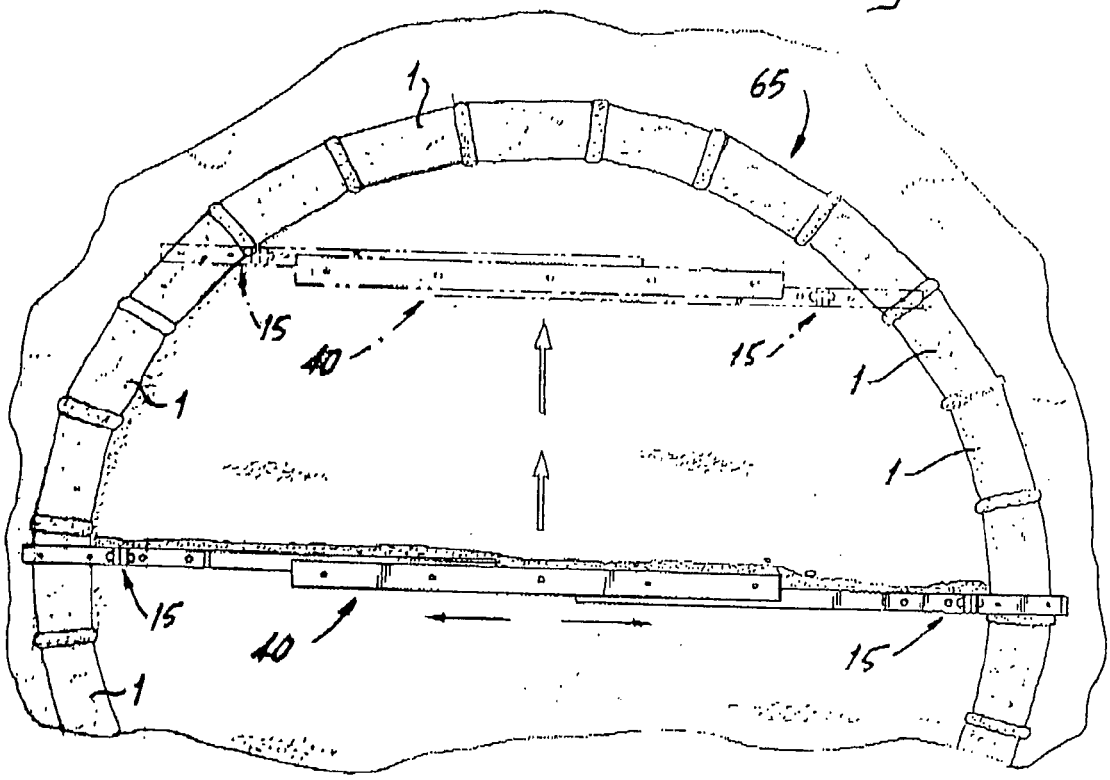

FIGS. 8–10 illustrate a third embodiment of height adjustable screed with a width adjustable feature. Width adjustable screed 40 includes a plurality of separate subassemblies, such as three subassemblies, including two outer parts 50 and 53 and a central part 41. Central part 41 includes plank 42 with short flush-mounted stud 45, long stud 44, and short stud 47 and long stud 46 mounted from the opposite side. A top bearing strip 43 is attached on top. The side parts are similar, including slotted boards 48 and 51 with bracket 16 attached at the top of one end.

Three screed boards, 42, 51 and 48 have the same height and can have the same width. The number of boards is not limited to three, although three screed boards work most efficiently.

FIG. 9 shows the three screed board subassemblies 41, 50 and 53, assembled into a complete height and width adjustable screed. A full bracket kit 15 is used at each end. Short studs 44 and 47 engage slots 49 and 52 respectively but do not extend beyond the thickness of screed boards 48 and 51.

Long studs 45 and 46 extend beyond screed boards 48 and 51 respectively to receive fender washers 58 and wing nuts 59. The use of short studs prevents interference or injury when using wing nuts 59. The double studs within the slots guide boards 48, 49, and 51 are provided to adjust in a horizontal direction, keeping their bottom surfaces in registration.

Top bearing strip 43 attached to the top of central plank 42 is wider than plank 42 and engages the top edges of outer planks 48 and 51 to support and further align the three boards so that they can act as if they were a solid screed board.

FIG. 10 is a top view showing adjustable width screed 40 at two positions with different width settings. Wing nuts 59 of FIG. 9 can be tightened to lock in a particular width, or then can be just slightly snugged up to permit screed 40 to follow a contour such as soldier's course 65 continuously in a dynamic manner.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. An adjustable paving stone screed for use in a rectangular area bounded by a course of paving stones comprising:

an elongated board rectangular in crossection having a top surface, a bottom surface, and side surfaces, the height of said board being the distance between said top and bottom surfaces;

a first right angle bracket mounted on said top surface at each end of said board, each bracket having a bottom leg attached to said top surface of said board and an upright leg aligned with an end of said board;

a second right angle bracket at each end of said board having an upright leg engaged with the upright leg of said first right angle bracket and a bottom leg having a bottom surface, said second right angle bracket being positioned so that said bottom surface of the bottom leg is flush with a top surface of said paving stones; and, said second right angle bracket being adjustable vertically with respect to said first right angle bracket so that the bottom surface of said board is even with bottom surfaces of said paving stones, whereby sliding movement of said board in said area with each bottom leg of said second right angle bracket riding along top surfaces of said paving stones establishes a flat plane of bedding material bed at a depth equal to that of said course of paving stones in said area to support paving stones to fill said area.

2. The adjustable paving stone screed of claim 1 wherein said height of said board is greater than height of said paving stones.

3. The adjustable paving stone screed of claim 2 in which the bottom leg of said first right angle bracket is attached to said top surface of said board using screws.

4. The adjustable paving stone screed of claim 2 in which the bottom leg of said first right angle bracket has a channel which encloses the sides and top surface of said board with clamping screws employed to secure said first right angle bracket to said board.

5. The adjustable paving stone screed of claim 2 in which the upright legs of said first and second right angle brackets have vertically extending slots so that said upright legs to allow the vertical adjustment with respect to each other, with carriage bolts engaging said slots to secure said first and second right angle brackets to each other.

6. An adjustable paving stone screed for use in an area bounded by a course of paving stones comprising:

first and second corresponding elongated members having coextensive slots;

a first right angle bracket mounted on a top surface at one end of said first member, said first bracket having an upright leg aligned with the adjacent end of said first member;

a second right angle bracket mounted on a top surface at an opposite end of said second member, said second bracket having an upright leg aligned with the adjacent opposite end of said second member;

a third elongated member between said first and second members having means to allow said first and second members to slide with respect to said third member to expand or reduce the length of said screed;

third and fourth right angle brackets mounted on said first and second right angle brackets, respectively, with upright legs of said third and fourth right angle brackets engaged with the upright legs of said first and second right angle brackets, and bottom legs extending away from the first and second right angle brackets, said third and fourth right angle brackets being positioned so that said bottom surfaces of the bottom legs thereof are flush with top surfaces of said paving stones; and, said third and fourth right angle brackets being adjustable vertically with respect to said first and second right angle brackets so that bottom surfaces of said members are even with bottom surfaces of said paving stones, whereby sliding movement of said members in said area with each bottom leg of said third and fourth right angle brackets riding along top surfaces of said paving stones establishes a flat plane of bedding material bed at a depth equal to that of said course of paving stones in said area to support paving stones to fill said area.

7. The adjustable paving stone screed of claim 6 in which said third member has a pair of studs on each side thereof to ride in said elongated slots of said first and second members, one stud of each pair of studs being threaded to receive lock nuts to fix the length of said screed.

8. The adjustable paving stone screed of claim 7 in which a bearing strip is mounted on a top surface of said third member, said bearing strip being wide enough to engage top surfaces of said first and second members for aligning all three members to function as a solid screed assembly.

9. A method of establishing a uniform bed of bedding material for paving stones in an area bounded by a course of said paving stones comprising the steps of:

placing in said area a screed having a length equal to the distance between opposite sides of said course of said paving stones, said screed being elongated and having a first right angle bracket mounted on a top surface at one end and a second right angle bracket at an opposite end thereof, each bracket having a bottom leg attached to a top surface of said screed and an upright leg aligned with an end of said screed, and a second right angle bracket at each end of said screed having an upright leg engaged with the upright leg of said first right angle bracket and a bottom leg having extending outwardly from each end of said screed;

positioning said screed so that said screed spans a space in said area between paving stones in said course with each extended bottom leg flush with top surfaces of said paving stones in said course;

adjusting vertically said each second right angle bracket with respect to each said first right angle bracket so that a bottom surface of said screed is aligned with bottom surfaces of said course of paving stones; and, sliding said screed in said area with each bottom leg of each said second right angle bracket riding along top surfaces of said paving stones to establish a flat plane of bedding material bed at a depth equal to that of said course of paving stones in said area to support paving stones to fill said area.

10. The method of claim 9 in which the length of said screed is adjusted to compensate for changing spans of said area as said screed is moved.

* * * * *